US007999486B2

(12) United States Patent
Wang et al.

(10) Patent No.: US 7,999,486 B2
(45) Date of Patent: Aug. 16, 2011

(54) DRIVING CIRCUIT AND METHOD FOR LIGHT EMITTING DIODE

(75) Inventors: Chun-Kai Wang, Tainan County (TW); Chin-Lung Wu, Tainan County (TW)

(73) Assignee: Himax Analogic, Inc., Tainan County (TW)

( * ) Notice: Subject to any disclaimer, the term of this patent is extended or adjusted under 35 U.S.C. 154(b) by 751 days.

(21) Appl. No.: 12/049,572

(22) Filed: Mar. 17, 2008

(65) Prior Publication Data

US 2009/0230880 A1 Sep. 17, 2009

(51) Int. Cl.
*H05B 37/02* (2006.01)

(52) U.S. Cl. ..... 315/291; 315/307

(58) Field of Classification Search ..... 315/209 R, 315/224–226, 291, 307, 308, 312
See application file for complete search history.

(56) References Cited

U.S. PATENT DOCUMENTS

| | | | | |
|---|---|---|---|---|
| 7,425,803 | B2 * | 9/2008 | Shao et al. | 315/308 |
| 7,880,400 | B2 * | 2/2011 | Zhou et al. | 315/247 |
| 2008/0001547 | A1 * | 1/2008 | Negru | 315/189 |

* cited by examiner

*Primary Examiner* — Jacob Y Choi
*Assistant Examiner* — Jimmy T Vu
(74) *Attorney, Agent, or Firm* — J.C. Patents

(57) ABSTRACT

A driving circuit for a light emitting diode (LED) and a method thereof are provided. The driving circuit includes a voltage converting circuit and a reference voltage generator. The reference voltage generator generates a reference voltage according to the cathode voltage of the LED. The voltage converting circuit automatically adjusts the driving voltage of the LED based on the reference voltage so as to reduce the possibility of unnecessary power wastage caused by high driving voltage.

21 Claims, 7 Drawing Sheets

DRIVING CIRCUIT AND METHOD FOR LIGHT EMITTING DIODE

BACKGROUND OF THE INVENTION

1. Field of the Invention

The present invention generally relates to a driving circuit and a method thereof, and more particularly, to a driving circuit having dynamically-adjustable output power and high energy efficiency and a method thereof.

2. Description of Related Art

Light emitting diode (LED) has been broadly applied to status indicators on electronic devices, backlight modules of liquid crystal displays, electronic illuminations, automobile lights, traffic lights and signals, flashlights, architectural lightings, or even illumination in projectors for it has such advantages as low electricity consumption and high on/off speed. Moreover, LED has been established in new applications since it was adopted as backlighting of high end cell phones, and the most promising application thereof is to 7-40 inches flat panel displays. The market profit of LED will increase considerably once it is adopted as back lightings of flat panel displays.

When a circuit or backlight module composed of a plurality of LEDs connected in series is driven, the turn-on voltages of the LEDs are slightly different from each other due to process variation, therefore to turn on all the LEDs, the output voltage of the driving circuit is usually set to a high voltage level so as to prevent that a particular LED having higher turn-on voltage cannot be turned on, which causes unnecessary power wastage.

FIG. 1 is a diagram of a conventional driving circuit. The conventional driving circuit includes a boost circuit 100 and a current source unit 140 and is used for driving a plurality of LED strings 111~119. The boost circuit 100 adjusts the voltage level of the output voltage VOUT according to the duty cycle of the tuning signal SRE. When the driving circuit is in operation, the voltage level of the output voltage VOUT can be determined as long as the input voltage VIN and the duty cycle of the tuning signal SRE are determined, and the output voltage VOUT is adjusted to a high voltage level in order to turn on all the LED strings 111~119 (to allow them to emit lights). Thus, the current source unit 140 has to receive a lot of voltage drops, and which causes unnecessary power wastage.

SUMMARY OF THE INVENTION

Accordingly, the present invention is directed to a driving circuit having dynamically-adjustable output power, and the driving circuit is suitable for driving a light emitting diode (LED), wherein the output voltage of the driving circuit is adjusted automatically with the cathode voltage of the LED so that the problems of unnecessary energy wastage and short load life of the LED in the conventional technique can be resolved.

The present invention further provides a driving circuit having dynamically-adjustable output power, and the driving circuit is suitable for driving a plurality of LEDs at the same time and adjusting the driving voltage thereof according to the cathode voltages of the LEDs so as to avoid unnecessary power wastage.

The present invention further provides a driving circuit having dynamically-adjustable output power, and the driving circuit is suitable for driving a plurality of LED strings and adjusting the driving voltage thereof according to the cathode voltages of the LEDs so as to avoid unnecessary power wastage.

The present invention further provides a method of designing a driving circuit having dynamically-adjustable output power, wherein whether or not the driving voltage of the driving circuit is too high is determined based on the cathode voltage of a LED, and the driving voltage of the driving circuit is adjusted to an appropriate voltage level to avoid unnecessary power wastage.

The present invention provides a circuit for driving at least one LED. The circuit includes a voltage converting circuit and a reference voltage generator. The voltage converting circuit converts an input voltage into an output voltage and provides the output voltage to the anode of the LED, wherein the output voltage corresponds to a reference voltage. The reference voltage generator generates the reference voltage, and the reference voltage corresponds to the cathode voltage of the LED.

According to an embodiment of the present invention, the reference voltage generator includes a detection unit and a pulse width tuning unit. The detection unit outputs the reference voltage according to the cathode voltage of the LED, and the pulse width tuning unit adjusts the duty cycle of a tuning signal according to the reference voltage and a feedback voltage corresponding to the output voltage. If the cathode voltage of the LED is higher than a threshold voltage, the voltage converting circuit reduces the output voltage according to the duty cycle of the tuning signal.

The present invention provides a circuit for driving a plurality of LEDs. The circuit includes a voltage converting circuit and a reference voltage generator. The voltage converting circuit converts an input voltage into an output voltage and provides the output voltage to the anodes of the LEDs, wherein the output voltage corresponds to a reference voltage. The reference voltage generator generates the reference voltage, wherein the reference voltage corresponds to the cathode voltage of one of the LEDs.

The present invention provides a circuit for driving a plurality of LED strings, wherein each of the LED strings is composed of a plurality of LEDs connected in series. The circuit includes a voltage converting circuit and a reference voltage generator. The voltage converting circuit converts an input voltage into an output voltage and provides the output voltage to the first ends (anodes) of the LED strings, wherein the output voltage corresponds to a reference voltage. The reference voltage generator generates the reference voltage, wherein the reference voltage corresponds to the voltage of a second end (cathode) of one of the LED strings.

According to another aspect of the present invention, a method for driving a plurality of LED strings is provided, wherein each LED string is composed of a plurality of LEDs connected in series. The method includes following steps. First, an input voltage is converted into an output voltage, and the output voltage is provided to the first ends (anodes) of the LED strings, wherein the output voltage corresponds to a reference voltage. Next, a reference voltage is produced, and the reference voltage corresponds to the voltage of a second end (cathode) of one of the LED strings. Next, the output voltage is adjusted according to the reference voltage.

According to the present invention, the output voltage of a driving circuit is dynamically adjusted through the cathode voltage of a LED with a feedback concept, so that the possibility of unnecessary power wastage caused by extra voltage drop on current source may be effectively reduced.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
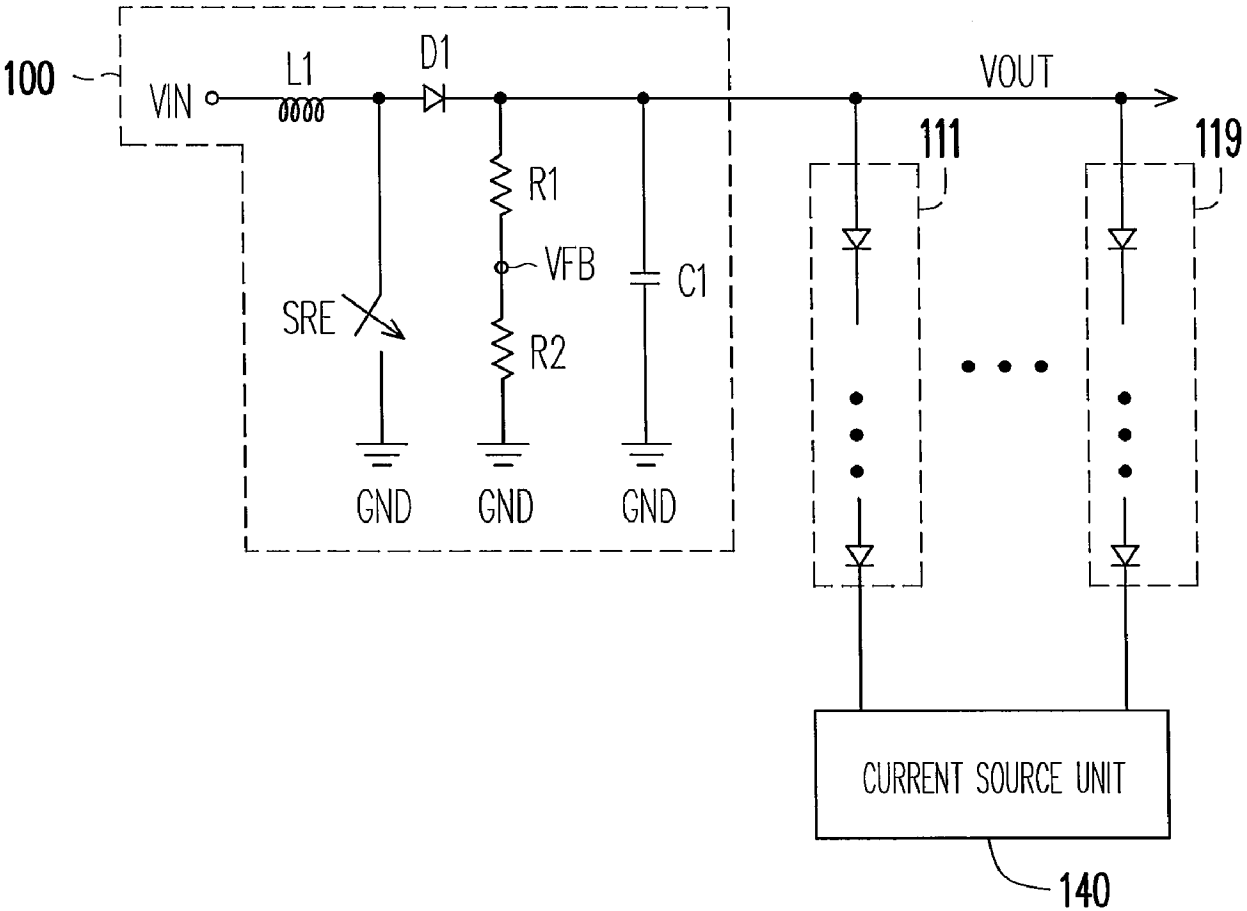
FIG. 1 is a diagram of a conventional driving circuit.

Reference will now be made in detail to the present preferred embodiments of the invention, examples of which are illustrated in the accompanying drawings. Wherever possible, the same reference numbers are used in the drawings and the description to refer to the same or like parts.

First Embodiment

Figure 2A:
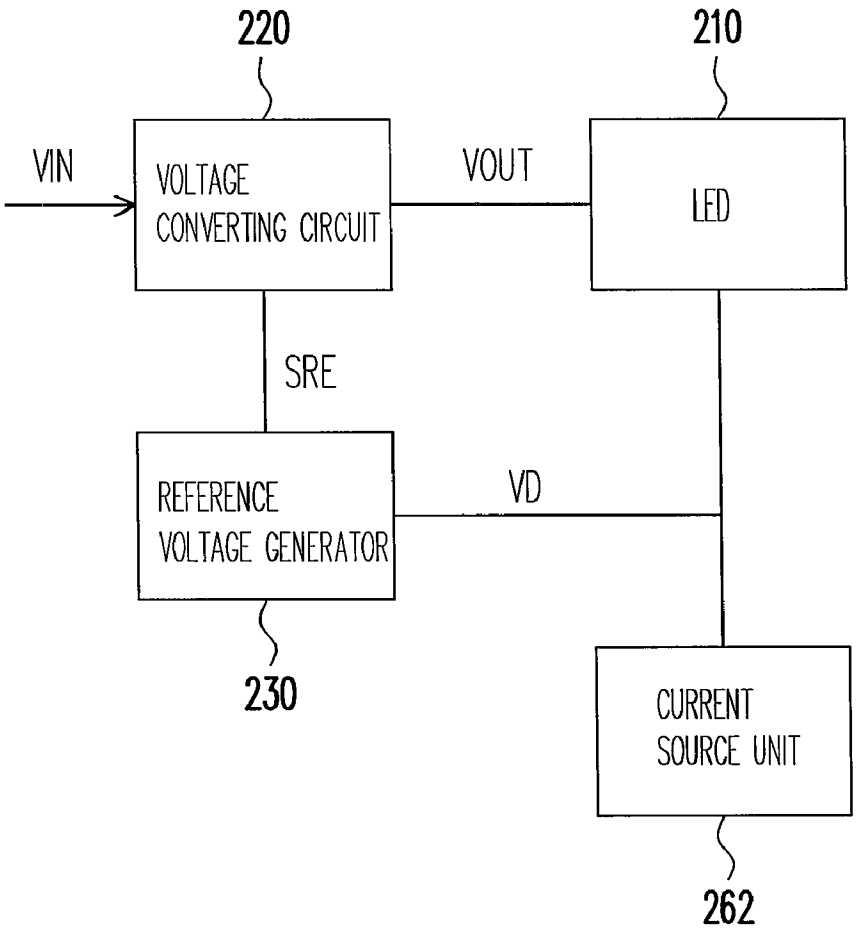
FIG. 2A is a block diagram of a driving circuit according to a first embodiment of the present invention.

FIG. 2A is a block diagram of a driving circuit according to a first embodiment of the present invention. Referring to FIG. 2A, the driving circuit in the present embodiment includes a voltage converting circuit 220 and a reference voltage generator 230. The reference voltage generator 230 is coupled between the voltage converting circuit 220 and a LED 210. The anode of the LED 210 is coupled to the voltage converting circuit 220, and the cathode thereof is coupled to a current source unit 262. The voltage converting circuit 220 converts an input voltage VIN into an output voltage VOUT and provides the output voltage VOUT to the anode of the LED 210, wherein the output voltage VOUT corresponds to the reference voltage output by the reference voltage generator 230.

The reference voltage generator 230 outputs the reference voltage according to the cathode voltage VD of the LED 210, and then converts the reference voltage into a tuning signal SRE to output to the voltage converting circuit 220. The voltage converting circuit 220 adjusts the voltage level of the output voltage VOUT according to the duty cycle of the tuning signal SRE. When the output voltage VOUT is too high, a voltage drop is produced at the cathode of the LED 210 and the reference voltage generator 230 then adjusts the duty cycle of the tuning signal SRE in order to lower the output voltage VOUT. Thus, the possibility of unnecessary power wastage can be effectively reduced.

Figure 2B:
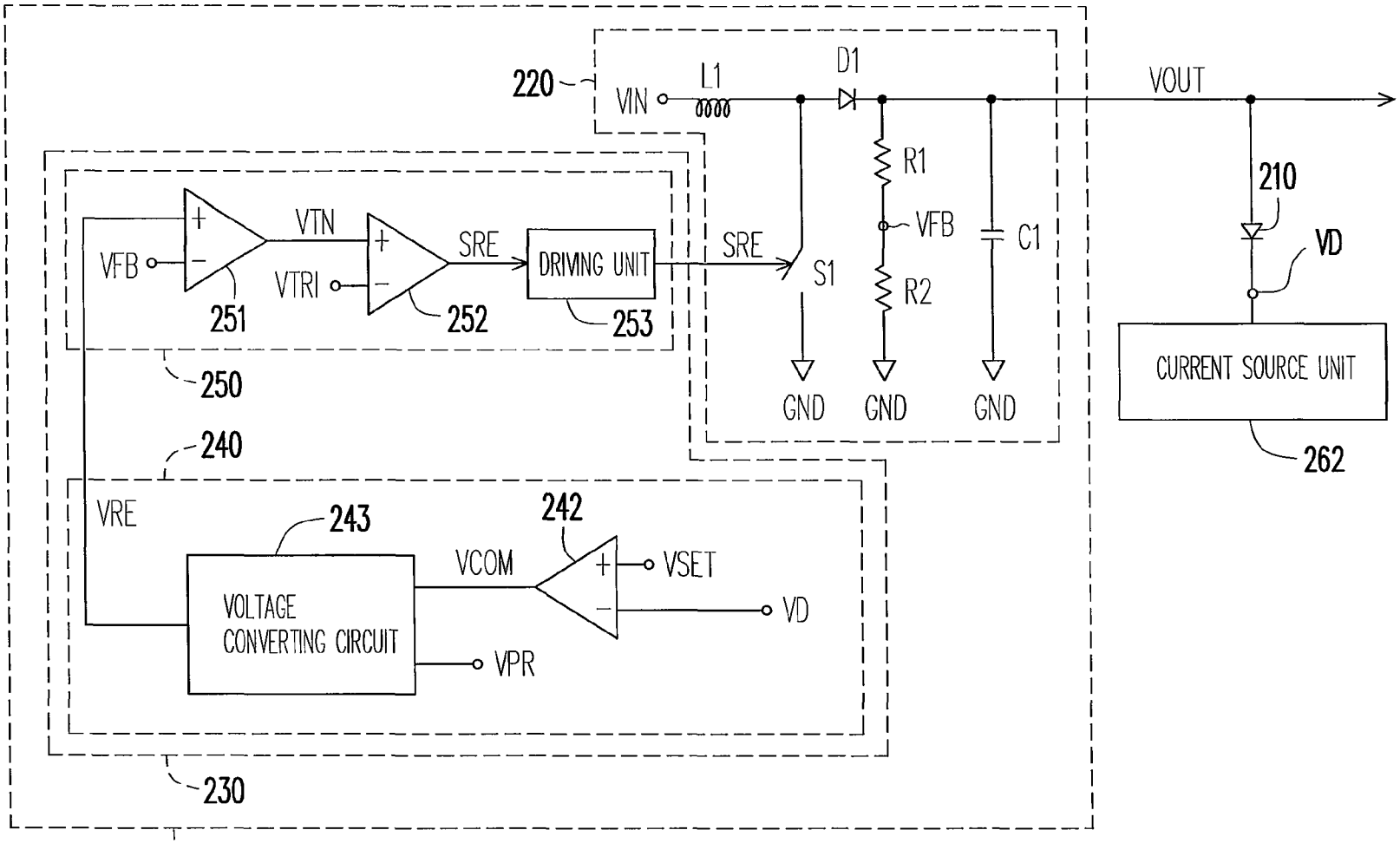
FIG. 2B is a diagram of a driving circuit according to the first embodiment of the present invention.

Hereinafter, the structure and operation details of the driving circuit of the present embodiment will be described. FIG. 2B is a diagram of a driving circuit according to the first embodiment of the present invention. Referring to FIG. 2B, the driving circuit 200 includes a voltage converting circuit 220 and a reference voltage generator 230. The voltage converting circuit 220 converts an input voltage VIN into an output voltage VOUT for driving a LED 210. The reference voltage generator 230 is coupled between the cathode of the LED 210 and the voltage converting circuit 220, and outputs a reference voltage VRE according to the cathode voltage of the LED 210 for adjusting the output voltage VOUT so as to reduce the possibility of unnecessary power wastage.

The reference voltage generator 230 includes a detection unit 240 and a pulse width tuning unit 250. The detection unit 240 further includes a comparator 242 and a voltage converting circuit 243. The pulse width tuning unit 250 includes an amplifier 251, a comparator 252, and a driving unit 253. The detection unit 240 is coupled to the cathode of the LED 210 and adjusts the reference voltage VRE according to the cathode voltage VD between the LED 210 and a current source unit 212. The pulse width tuning unit 250 changes the duty cycle of the tuning signal SRE according to the reference voltage VRE and the feedback voltage VFB corresponding to the output voltage VOUT. In other words, when the cathode voltage VD of the LED 210 is higher than a threshold voltage (i.e. the preset voltage VSET of the detection unit 240 in FIG. 2, which may be determined according to the design requirement), the reference voltage generator 230 changes the duty cycle of the tuning signal SRE so as to lower the output voltage VOUT and thereby reduces the possibility of unnecessary power wastage caused by high output voltage VOUT.

In the detection unit 240, the comparator 242 outputs a comparison voltage VCOM to the voltage converting circuit 243 according to the cathode voltage VD and the preset voltage VSET. The voltage converting circuit 243 then outputs the reference voltage VRE to the pulse width tuning unit 250 according to the comparison voltage VCOM and a preset tuning voltage VPR. The main function of the voltage converting circuit 243 is to output a corresponding reference voltage VRE according to the tuning mechanism of the pulse width tuning unit 250 for adjusting the duty cycle of the tuning signal SRE.

In the pulse width tuning unit 250, the amplifier 251 outputs a tuning voltage VTN according to the reference voltage VRE and the feedback voltage VFB, wherein the tuning voltage VTN is a differential gain between the reference voltage VRE and the feedback voltage VFB. The comparator 252 then outputs the tuning signal SRE according to the comparison result between the tuning voltage VTN and a triangle wave signal VTRI. The duty cycle of the tuning signal SRE changes along with the voltage level of the tuning voltage VTN. The driving unit 253 is coupled between the comparator 252 and the voltage converting circuit 220 for intensifying the driving capability of the tuning signal SRE.

In the present embodiment, the voltage converting circuit 220 may be a boost circuit or a buck circuit. A boost circuit is illustrated in FIG. 2B as an example. The output voltage VOUT of the boost circuit is determined by the duty cycle of the tuning signal SRE. The boost circuit includes a switch S1, an inductor L1, a first resistor R1, a second resistor R2, a capacitor C1, and a diode D1. The inductor L1 is coupled between the input voltage VIN and the switch S1, and the other end of the switch S1 is coupled to a ground terminal GND. The diode D1 is coupled between the inductor L1 and the output voltage VOUT, and the capacitor C1 is coupled between the output voltage VOUT and the ground terminal GND.

Besides, the first resistor R1 and the second resistor R2 are connected in series between the output voltage VOUT and the ground terminal GND, and the feedback voltage VFB produced at the junction between the two is a divisional voltage of the output voltage VOUT. A control end of the switch S1 is coupled to the tuning signal SRE, and the boost circuit adjusts the output voltage VOUT to drive the LED 210 according to the duty cycle of the tuning signal SRE. A current source 262 is coupled between the cathode of the LED 210 and the ground terminal GND for restricting the current passing through the LED 210, so as to protect the LED 210 and adjust the luminance of the LED 210.

In the present embodiment, the duty cycle of the tuning signal SRE is determined according to the voltage VD between the LED 210 and the current source 212. When the output voltage VOUT is too high, a voltage drop, i.e. the cathode voltage VD, is produced at the junction between the LED 210 and the current source unit 262. The driving circuit 200 then determines whether or not the output voltage VOUT is too high based on the variation of the cathode voltage VD so as to adjust the voltage level of the output voltage VOUT. In other words, when the cathode voltage VD of the LED 210 is greater than a threshold voltage (i.e. the preset voltage VSET), the voltage converting circuit 220 lowers the output voltage VOUT according to the duty cycle of the tuning signal SRE so as to reduce unnecessary power waste.

Second Embodiment

Figure 3:
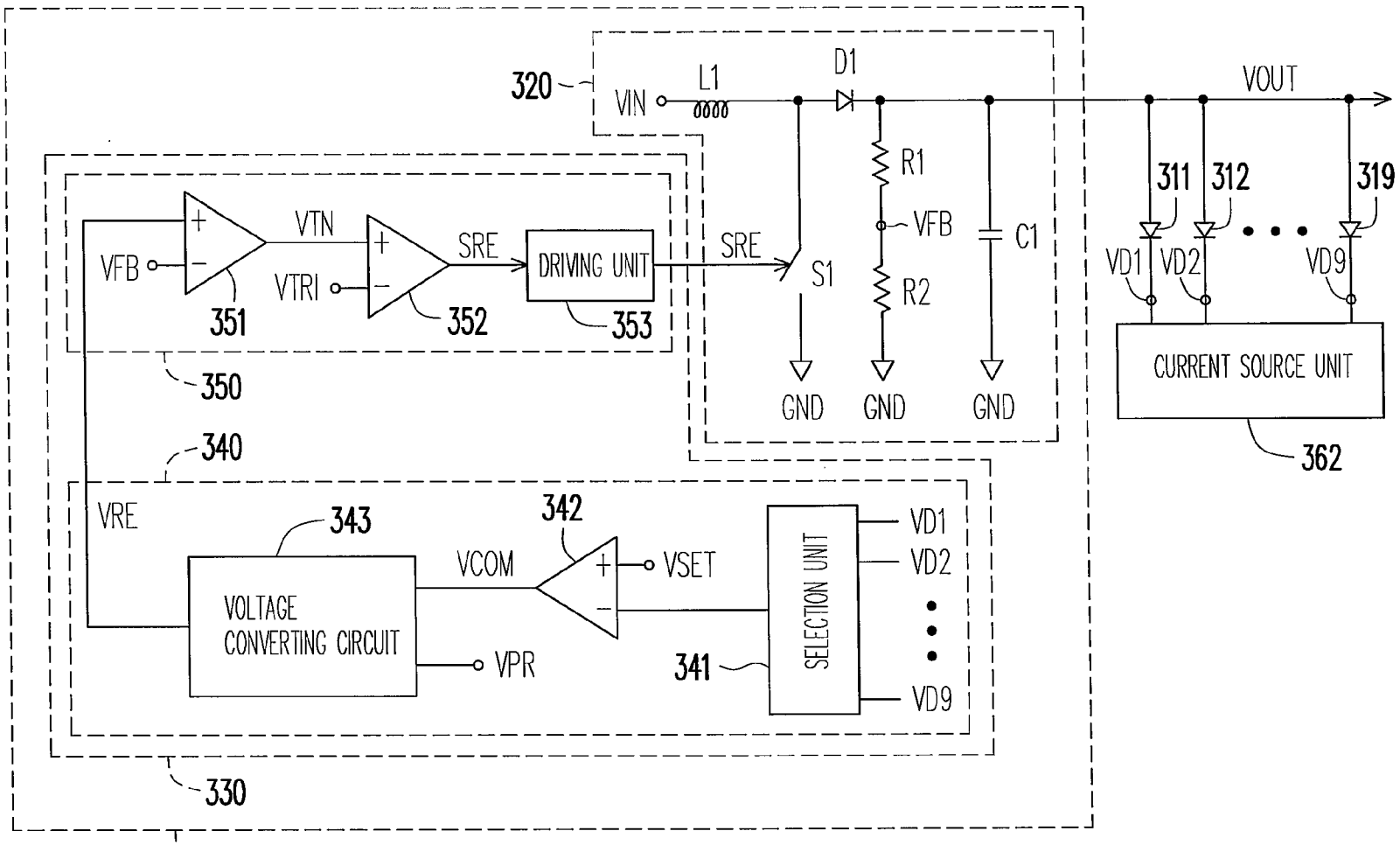
FIG. 3 is a diagram of a driving circuit according to a second embodiment of the present invention.

FIG. 3 is a diagram of a driving circuit according to a second embodiment of the present invention. Referring to FIG. 3, the driving circuit 300 in the present embodiment is suitable for driving a plurality of LEDs 311~319. The main difference of the driving circuit 300 from the driving circuit 200 in FIG. 2B is at the selection unit 341 in the detection unit 330. The selection unit 341 selects to output the lowest value among the cathode voltages VD1~VD9 of the LEDs. The comparator 342 compares the lowest value among the cathode voltages VD1~VD9 of the LEDs 311~319 and a preset voltage VSET and produces a comparison voltage VCOM. The voltage converting circuit 343 outputs a reference voltage VRE according to the comparison voltage VCOM and a preset tuning voltage VPR. Then, the output voltage VOUT changes along with the reference voltage VRE.

Due to process variation, the turn-on voltages of the LEDs 311~319 may be slightly different. The lower the turn-on voltage of the LED is, the higher the cathode voltage of the LED is. When the output voltage VOUT is higher than the turn-on voltages required by the LEDS 311~319, the current source unit 362 has to endure an additional voltage drop of the output voltage VOUT, and accordingly unnecessary power wastage is incurred.

The driving circuit 300 works properly as long as the output voltage VOUT is higher than the highest turn-on voltage of the LEDs 311~319, thus, whether or not the output voltage VOUT is too high can be determined based on the lowest value among the cathode voltages VD1~VD9 of the LEDs 311~319. In other words, all the LEDs 311~319 can be turned on as long as the lowest value among the cathode voltages VD1~VD9 is maintained higher than a preset voltage VSET.

Accordingly, in the present embodiment, the output voltage VOUT is adjusted according to the lowest value among the cathode voltages VD1~VD9 of the LEDs 311~319. When the lowest value among the cathode voltages VD1~VD9 of the LEDs 311~319 is higher than the preset voltage VSET, the voltage converting circuit 320 lowers the output voltage VOUT until the lowest value among the cathode voltages VD1~VD9 of the LEDs 311~319 is lower than the preset voltage VSET. The other operation details in the present embodiment has been described in the embodiment in FIG. 2B, and those of ordinary skill in the art would easily understand them by referring to foregoing description, therefore the same description will not be repeated.

Third Embodiment

Figure 4:
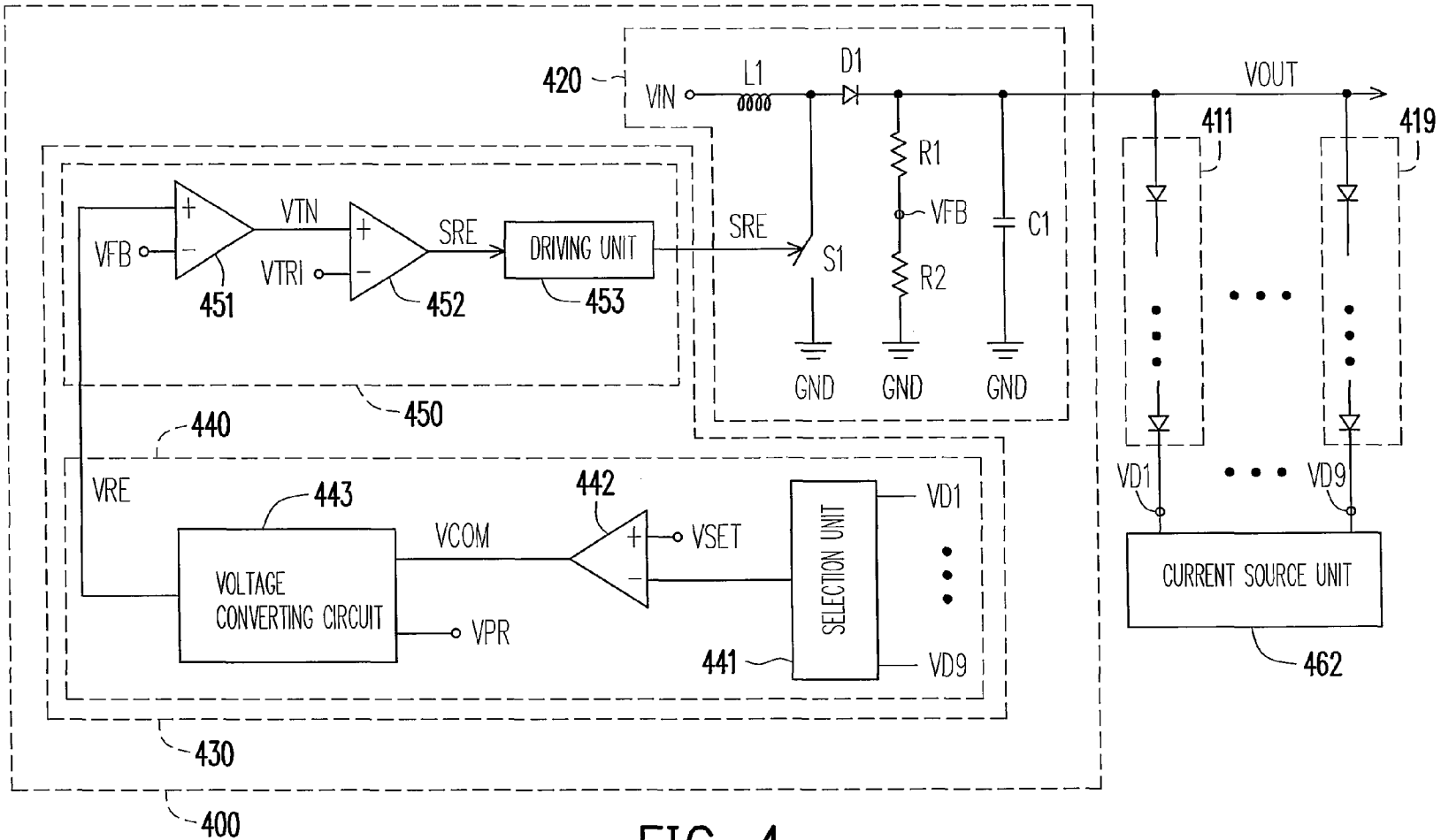
FIG. 4 is a diagram of a driving circuit according to a third embodiment of the present invention.

FIG. 4 is a diagram of a driving circuit according to a third embodiment of the present invention. Referring to FIG. 4, the driving circuit 400 in the present embodiment is suitable for driving a plurality of LED strings 411~419, wherein each of the LED strings 411~419 is composed of a plurality of LEDs connected in series. The structure of the driving circuit 400 is similar to that of the driving circuit 300 in FIG. 3, wherein the voltage converting circuit 420 converts an input voltage VIN into an output voltage VOUT and provides the output voltage VOUT to the first ends (anodes) of the LED strings 411~419, wherein the output voltage VOUT corresponds to a reference voltage VRE. The reference voltage generator 440 outputs the reference voltage VRE according to one of the cathode voltages VD1~VD9 at the second ends of the LED strings 411~419.

Referring to the description with reference to FIG. 3, similarly, the LED string having the highest turn-on voltage can be obtained as long as the lowest value among the cathode voltages VD1~VD9 is located. Then, the voltage converting circuit 420 adjusts the output voltage VOUT according to the lowest value among the cathode voltages VD1~VD9 of the LED strings 411~419. When the lowest value among the cathode voltages VD1~VD9 of the LED strings 411~419 is too high (higher than a preset voltage VSET), the voltage converting circuit 420 lowers the output voltage VOUT so as to reduce the possibility of unnecessary power wastage. The remaining operation details of the present embodiment are similar to those of the embodiment described with reference to FIG. 3, therefore will not be repeated.

Fourth Embodiment

Figure 5:
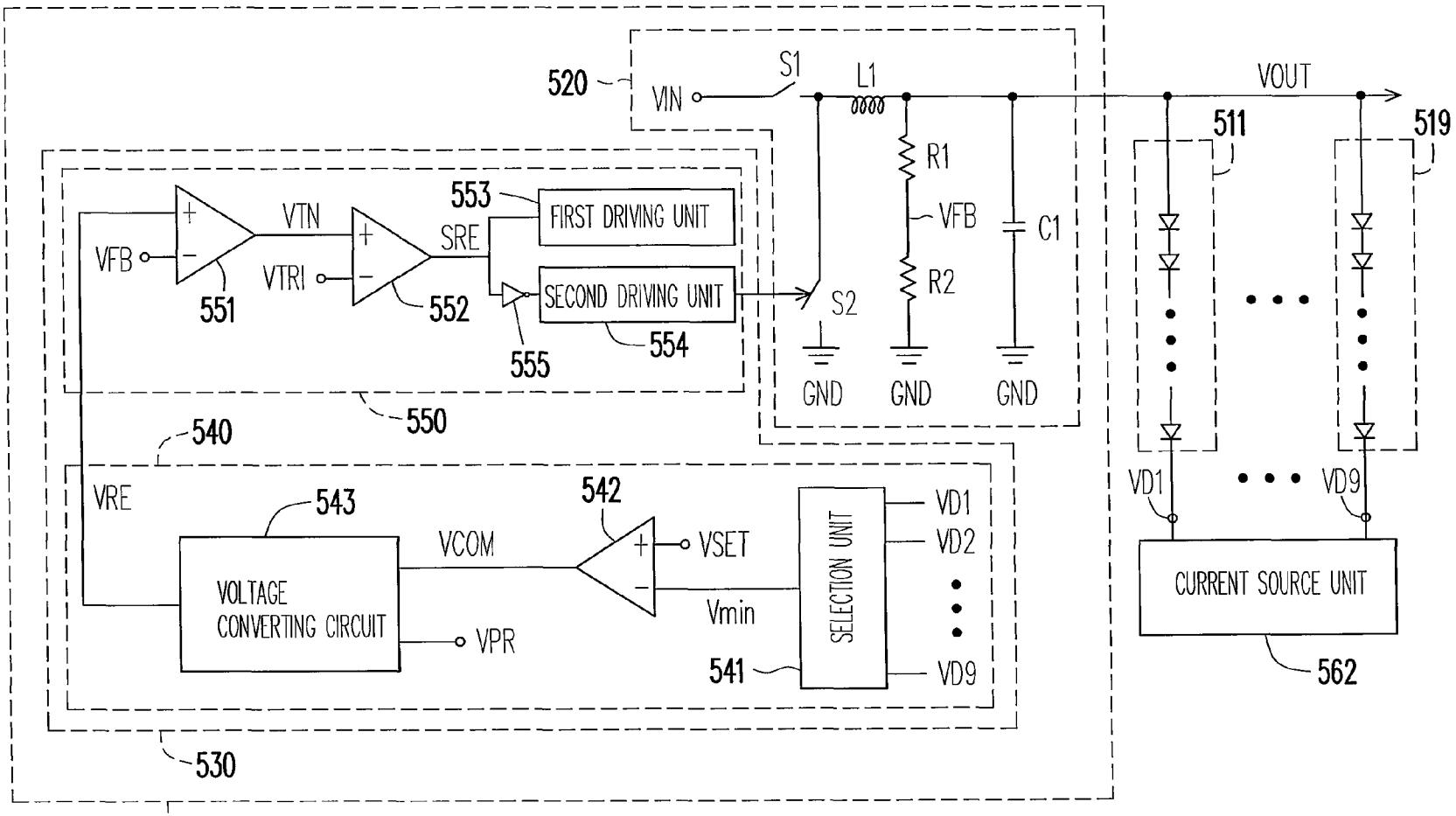
FIG. 5 is a diagram of a driving circuit according to a fourth embodiment of the present invention.

The voltage converting circuit may be a buck circuit in another embodiment of the present invention. FIG. 5 is a diagram of a driving circuit according to a fourth embodiment of the present invention. Referring to FIG. 5, the voltage converting circuit 520 is a buck circuit which includes a first switch S1, a second switch S2, an inductor L1, a first resistor R1, a second resistor R2 and a capacitor C1. The first resistor R1 is connected to the second resistor R2 in series, and one end of the first resistor R1 is coupled to a plurality of LED strings 511~519, and the other end thereof is connected to a ground terminal GND. A feedback voltage VFB can be detected at the junction between the first resistor R1 and the second resistor R2, and the feedback voltage VFB is a constant divisional voltage of the output voltage VOUT. One end of the inductor L1 is coupled to the junction between the first switch S1 and the second switch S2, and the other end thereof is coupled to the LED strings 511~519. The other end of the first switch S1 is coupled to the input voltage VIN, and the other end of the second switch S2 is connected to the ground terminal GND. One end of the capacitor C1 is coupled to the LED strings 511~519, and the other end thereof is coupled to the ground terminal GND.

The major difference of the present embodiment from the embodiment illustrated in FIG. 4 is about an inverter 555, a first driving unit 553, and a second driving unit 554 of the pulse width tuning unit 550. Since the output voltage VOUT of the voltage converting circuit 520 is determined by the turn-on time of the first switch S1 and the second switch S2, the voltage level of the output voltage VOUT can be adjusted by changing the duty cycle of the tuning signal SRE. When the driving circuit 500 is in operation, the turn-on time of the first switch S1 and the turn-on time of the second switch S2 are contrary to each other, thus, the tuning signal SRE is passed through the inverter 555 before it is output to the second switch S2.

In the present embodiment, the reference voltage generator 530 also adjusts the reference voltage VRE according to the lowest value among the cathode voltages VD1~VD9 of the LED strings 511~519 and further changes the duty cycle of the tuning signal SRE so as to adjust the voltage level of the output voltage VOUT. When the output voltage VOUT is too high and accordingly a very high voltage drop is produced at the LED strings 511~519 and the current source unit 562, the reference voltage generator 530 changes the duty cycle of the tuning signal SRE so as to lower the voltage level of the output voltage VOUT and reduce the possibility of unnecessary power wastage. The remaining operation details of the present embodiment would be understood by those having ordinary knowledge in the art according to the present disclosure therefore will not be repeated.

Fifth Embodiment

Figure 6:
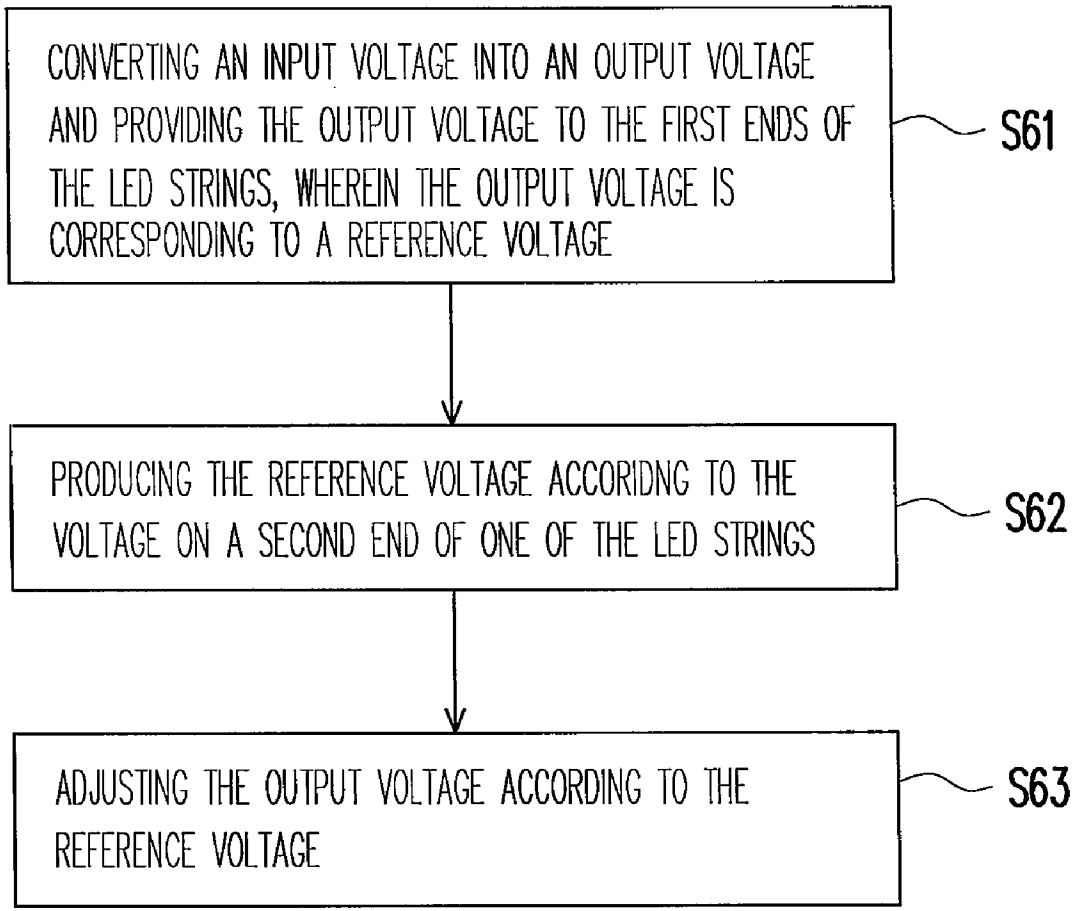
FIG. 6 is a flowchart illustrating a driving method according to a fifth embodiment of the present invention.

According to another aspect of the present embodiment, a LED driving method is provided, which driving method may effectively reduce the possibility of power wastage. FIG. 6 is a flowchart illustrating a driving method according to a fifth embodiment of the present invention. The driving method in the present embodiment is suitable for driving a plurality of LED strings, wherein each LED string is composed of a plurality of LEDs connected in series. The driving method includes following steps. First, in step S61, an input voltage is converted into an output voltage, and the output voltage is provided to the first ends (the anodes) of the LED strings, wherein the output voltage corresponds to a reference voltage. Next, in step S62, a reference voltage is produced (adjusted) according to the voltage at the second end of one of the LED strings. Next, in step S63, the output voltage is adjusted according to the reference voltage. In the present embodiment, a dynamic balance is maintained between the output voltage and the reference voltage, changes of the output voltage will affect the reference voltage, and the reference voltage also affects the voltage level of the output voltage, so that the output voltage is prevented from being too high and accordingly the phenomenon of unnecessary power wastage may be effectively reduced. Other details regarding the driving method in the present embodiment has been described in foregoing descriptions of the embodiments illustrated in FIGS. 2~5, therefore will not be described herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A circuit for driving at least a light emitting diode, comprising:

a voltage converting circuit, for converting an input voltage to an output voltage applied to an anode of the light emitting diode, wherein the output voltage comprises a level corresponding to a reference voltage; and a reference voltage generator, for generating the reference voltage having a level corresponding to a voltage on a cathode of the light emitting diode, wherein the reference voltage generator comprises:

a detection unit, for outputting the reference voltage according to the voltage on the cathode of the light emitting diode; and a pulse width tuning unit, for tuning the duty cycle of a tuning signal according to the reference voltage and a feedback voltage corresponding to the output voltage;

wherein when the voltage on the cathode of the light emitting diode is higher than a threshold voltage, the voltage converting circuit lowers the output voltage according to the duty cycle of the tuning signal.

2. The circuit of claim 1, wherein the detection unit comprises:

a comparator, for comparing a voltage on the cathode of the light emitting diode with a default voltage and generating a comparison voltage; and a voltage transfer unit, for outputting the reference voltage according to the comparison voltage and a default tuning voltage.

3. The circuit of claim 1, wherein the pulse width tuning unit comprises:

an amplifier, for outputting a tuning voltage according to the reference voltage and the feedback voltage; and a comparator, for tuning the duty cycle of the tuning signal according to the tuning voltage and a triangle wave signal.

4. The circuit of claim 3, wherein the pulse width tuning unit comprises a driving unit coupled between the comparator and the voltage converting circuit.

5. The circuit of claim 1, wherein the feedback voltage is generated by means of resistors connected between the output voltage and ground.

6. The circuit of claim 1, wherein the voltage converting circuit comprises a boost circuit or a buck circuit.

7. A circuit for driving a plurality of light emitting diodes, comprising:

a voltage converting circuit, for converting an input voltage to an output voltage applied to anodes of the light emitting diodes, wherein the output voltage comprises a level corresponding to a reference voltage; and a reference voltage generator, for generating the reference voltage having a level corresponding to selected one of voltages on cathodes of the light emitting diodes, wherein the reference voltage generator comprises:

a detection unit, for outputting a reference voltage according to the lowest one of voltages on the cathodes of the light emitting diodes; and a pulse width tuning unit, for tuning the duty cycle of a tuning signal according to the reference voltage and a feedback voltage corresponding to the output voltage;

wherein when the voltage on the cathodes of the light emitting diodes is higher than a threshold voltage, the voltage converting circuit lowers the output voltage according to a duty cycle of the tuning signal.

8. The circuit of claim 7, wherein the detection unit comprises:

a selection circuit, for selecting and outputting a lowest one of voltages on the cathodes of the light emitting diodes;

a comparator, for comparing an output of the selection circuit with a default voltage and generating a comparison voltage; and a voltage transfer unit, for outputting the reference voltage according to the comparison voltage and a default tuning voltage.

9. The circuit of claim 7, wherein the pulse width tuning unit comprises:

an amplifier, for outputting a tuning voltage according to the reference voltage and the feedback voltage; and a comparator, for tuning the duty cycle of the tuning signal according to the tuning voltage and a triangle wave signal.

10. The circuit of claim 9, wherein the pulse width tuning unit comprises a driving unit coupled between the comparator and the voltage converting circuit.

11. The circuit of claim 7, wherein the feedback voltage is generated by means of resistors connected between the output voltage and the ground.

12. The circuit of claim 7, wherein the voltage converting circuit comprises a boost circuit or a buck circuit.

13. The circuit of claim 7, wherein the selected voltage is the lowest one among those of the light emitting diodes.

14. A circuit for driving a plurality of strings of light emitting diode, each of which comprising a plurality of light emitting diodes connected in series, the circuit comprising:

a voltage converting circuit, for converting an input voltage to an output voltage applied to first ends of the strings, wherein the output voltage comprises a level corresponding to a reference voltage; and a reference voltage generator, for generating the reference voltage having a level corresponding to a selected one of voltages on second ends of the strings, wherein the reference voltage generator comprises:

a detection unit, for outputting a reference voltage according to the lowest one of voltages on second ends of the strings; and a pulse width tuning unit, for tuning the duty cycle of a tuning signal according to the reference voltage and a feedback voltage corresponding to the output voltage;

wherein when the lowest one of voltages on second ends of the strings is higher than a threshold voltage, the voltage converting circuit lowers the output voltage according to the duty cycle of the tuning signal.

15. The circuit of claim 14, wherein the detection unit comprises:

a selection circuit, for selecting and outputting the lowest one of voltages on the second ends of strings, wherein the second ends include cathodes of the strings;

a comparator, for comparing the output of the selection circuit with the default voltage and generating a comparison voltage; and a voltage transfer unit, for outputting the reference voltage according to the comparison voltage and a default tuning voltage.

16. The circuit of claim 14, wherein the pulse width tuning unit comprises:

an amplifier, for outputting a tuning voltage according to the reference voltage and the feedback voltage; and a comparator, for tuning a duty cycle of the tuning signal according to the tuning voltage and a triangle wave signal.

17. The circuit of claim 16, wherein the pulse width tuning unit comprises a driving unit coupled between the comparator and the voltage converting circuit.

18. The circuit of claim 14, wherein the feedback voltage is generated by means of resistors connected between the output voltage and ground.

19. The circuit of claim 14, wherein the voltage converting circuit comprises a boost circuit or a buck circuit.

20. The circuit as recited in claim 14, wherein the selected voltage is the lowest one among those of the strings.

21. A method for driving a plurality of strings of light emitting diode, each of which comprising a plurality of light emitting diodes connected in series, comprising:

converting an input voltage to an output voltage applied to anodes of the strings, wherein the output voltage comprises a level corresponding to a reference voltage;

generating a reference voltage having a level corresponding to a selected one of voltages on cathodes of the strings; and tuning the output voltage according the reference voltage, wherein the step of tuning the output voltage according the reference voltage comprises:

lowering the output voltage when the lowest one of voltages on the cathodes of the strings is higher than a threshold voltage.

* * * * *